US006710535B2

(12) United States Patent
Versluijs

(10) Patent No.: US 6,710,535 B2
(45) Date of Patent: Mar. 23, 2004

(54) LOW-PRESSURE GAS DISCHARGE LAMPS

(75) Inventor: Cornelis Versluijs, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 19 days.

(21) Appl. No.: 10/210,500

(22) Filed: Aug. 1, 2002

(65) Prior Publication Data

US 2003/0025452 A1 Feb. 6, 2003

(30) Foreign Application Priority Data

Aug. 6, 2001 (EP) ..... 01202989

(51) Int. Cl.[7] ..... H01J 1/62
(52) U.S. Cl. ..... 313/493; 313/634
(58) Field of Search ..... 313/493, 634, 313/635, 607

(56) References Cited

U.S. PATENT DOCUMENTS 5,557,170 A * 9/1996 Ooms ..... 313/635

FOREIGN PATENT DOCUMENTS

EP 1043757 A1 11/2000 ..... H01J/65/04

* cited by examiner

*Primary Examiner*—Vip Patel
(74) *Attorney, Agent, or Firm*—Frank Keegan

(57) ABSTRACT

A low-pressure gas discharge lamp comprising a discharge vessel and at least two, spatially separated, capacitive induction structures, the vessel having a relatively small diameter of preferably 5 mm or less and comprising cylindrically shaped tubular induction structures of a dielectric material.

Figure 1:
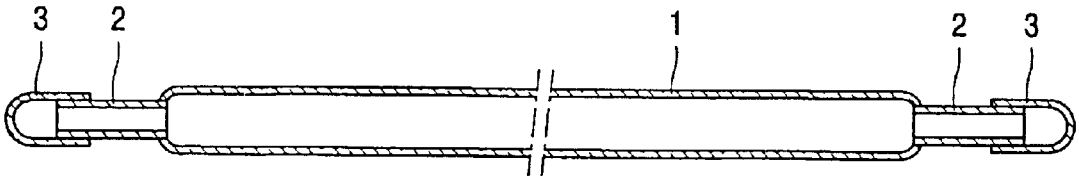

An external induction plate of the capacitive induction structure acts as an electric contact and is shaped as a bush and is made from electrically conducting, ductile metallic material. The bush is provided on and is in direct contact with the dielectric material of the cylindrically shaped tubular induction structure. It is ensured that the connection thus formed is gastight and has a permanent compression stress, for example, a shrink connection.

10 Claims, 1 Drawing Sheet

LOW-PRESSURE GAS DISCHARGE LAMPS

The invention relates to a low-pressure gas discharge lamp comprising a discharge vessel and at least two capacitive coupling structures which are spatially separated from one another, said discharge vessel having a small diameter of preferably 5 mm or less, while each coupling structure is formed by at least a cylindrical tube of dielectric material.

Known gas discharge lamps consist of a vessel with a filling gas in which the gas discharge takes place, usually with two metal electrodes fixedly sealed in the discharge vessel. A first electrode supplies the electrons for the discharge, and the electrons are removed to the external current circuit again through the second electrode. The supply of the electrons usually takes place by means of glow emission (hot electrodes), but it may alternatively be generated through emission in a strong electric field or directly through ion bombardment (ion-induced secondary emission) (cold electrodes).

In an inductive mode of operation, the charge carriers are directly generated in the gas volume by an electromagnetic AC field of high frequency (typically higher than 1 MHz in the case of low-pressure gas discharge lamps). The electrons move along closed trajectories within the discharge vessel, and conventional electrodes are absent in this mode of operation. Capacitive coupling structures are used as the electrodes in a capacitive mode of operation. These capacitive electrodes are usually formed from insulators (dielectrics) which are in contact at one side for the gas discharge and which are connected to an external current circuit with electrical conduction (for example by means of a metallic contact) at the other side. An AC electric field is formed when an AC voltage is applied to the capacitive electrodes, and the charge carriers move along the relevant linear electric fields. In the high-frequency range (f>10 MHz), capacitive lamps resemble inductive lamps because the charge carriers are generated throughout the entire gas volume also in the former case. The surface properties of the dielectric electrodes are of minor importance here (so-called $\alpha$-discharge mode). At lower frequencies, the capacitive lamps change their mode of operation, and the electrons important for the discharge must be emitted originally at the surface of the dielectric electrode and must be multiplied in a so-called cathode drop region so as to keep the discharge going. The emission behavior of the dielectric material, therefore, is a determining factor for the lamp function (the so-called $\gamma$-discharge mode).

It is advantageous in a number of applications to have available fluorescent lamps of small diameter (preferably 5 mm or less) and as great as possible a quantity of light per unit lamp length (lumens per cm). Furthermore, most areas of application require a high switching stability of the lamp. This is true in particular, for example, in the case of a background illumination for a liquid crystal display.

Hot-cathode lamps do not fulfill the above conditions, on the one hand for constructional reasons, and on the other hand because a small diameter of this type of lamps leads to an intensified blackening of the inner surface of the discharge vessel, which in its turn reduces lamp life.

Until recently, fluorescent lamps of small lamp diameter (5 mm or less) were found to be possible only in the form of cold-cathode lamps or in the form of capacitive gas discharge lamps with an operational frequency above 1 MHz.

Cold-cathode lamps can be operated at low frequencies (30 to 50 Hz) and accordingly show only a small electromagnetic radiation. The discharge current in this type of lamp, however, is strongly limited (to a maximum of approximately 10 mA). This is caused on the one hand by a strongly intensified sputtering of the electrode material in the case of higher discharge currents. On the other hand, current limitation is necessary for preventing the electrode being heated locally so strongly that thermal emission occurs, which also leads to a strongly intensified cathode sputtering. The electrode material removed through dissolution will deposit itself in the discharge vessel, which leads to a fast blackening of the lamp.

In a capacitive discharge lamp with an operating frequency f>1 MHz, the high operating frequency in combination with a high current density in the lamp (strong current, small lamp diameter) leads to a strong electromagnetic radiation. Large-scale measures have to be taken in order to limit this electromagnetic radiation. Since the power is capacitively coupled, the operating frequency is limited in downward direction (to approximately 1 MHz) by the capacitance of the coupling surface.

EP-A-1 043 757 describes a gas discharge lamp with a capacitive coupling structure. The object here is to supply the gas discharge lamp with the capacitive coupling structure from the public mains for private domestic use without a circuit with starter electronics. This can be achieved, according to this publication, through a suitable choice of dielectric saturation polarization and an effective surface area of the dielectric. This publication does not relate to a gas discharge lamp with a diameter of preferably 5 mm or less and with an accompanying high light output.

Investigations have shown that, as regards the dielectric, a certain ratio between the thickness of the dielectric and the product of the dielectric constant and the frequency can be of importance for obtaining a low-pressure gas discharge lamp with a high light output and with a small diameter, preferably smaller than 5 mm. The gas discharge lamp may suitably be composed of a transparent discharge vessel with a usual filling gas, and may be operated with a frequency f of an AC supply source. The material of the discharge vessel and the filling gas may be chosen so as to correspond to the desired spectrum of the generated radiation. In particular, the discharge vessel may be provided with a fluorescent layer, so that the lamp emits radiation in a certain frequency range (for example in the UV range). At least two mutually separated capacitive coupling structures are present. The dielectric may be composed of one or several layers. The lamp is suitable for operating with a discharge current greater than 10 mA, in which case only a small electromagnetic radiation will occur. The fields of application of such a gas discharge lamp are wide. An important application is, for example, the use as a background illumination of a liquid crystal display.

The invention relates to the latter type of gas discharge lamps. To achieve a practical applicability, however, further electrical, mechanical, and thermal problems are to be solved. The capacitive coupling structure formed by a cylindrical tube of dielectric material in the gas discharge lamp described in EP-A-1 043 757 is provided with a metallization, for example an electrically conducting silver paste. An electrical conductor is soldered to this layer for connection to an external current source. Such an electrical contacting, however, is problematic and not suitable for mass manufacture.

A first object of the invention is to provide a solution to this problem. According to the invention, this is achieved in that an element acting as an external capacitor plate of the capacitive coupling structure is constructed as a bush of electrically conducting, ductile metallic material, which bush is provided directly on the dielectric material of the cylindrical tube so as to form a gastight connection which is under compression stress.

An embodiment is obtained in this manner which is highly suitable for mass manufacture and which is mechanically and electrically highly reliable. The provision of a metallization, such as an electrically conducting silver paste, is unnecessary, which reduces the number of manufacturing steps by one. The bush is to be made from a ductile material so as to achieve that a gastight connection under compression stress is obtained. This is necessary on the one hand because the contact surface of the bush and of the tube of dielectric material is a determining factor for the capacitance value of the coupling structure. On the other hand, the gastight seal is desirable for preventing sparking effects between the bush and the dielectric tube, which effects could arise in locations where no full contact obtains. The bush has the further advantage over a silver paste that it has a greater heat absorption capacity. This may be further influenced by the choice of a suitable thickness for the bush.

The material of the bush provided in a gastight manner may favorably consist of one or several of the materials: copper, brass, aluminum, and mild steel.

According to a further preferable characteristic of the invention, the bush is made of an electrically conducting, ductile metallic material is provided on the cylindrical tube of dielectric material by means of a shrink compression joint. Such a connection method is highly suitable for mass manufacture.

The shrink compression joint is obtained in an embodiment through the use of the difference in thermal expansion between the dielectric material of the cylindrical tube and the metallic material of the electrically conducting bush. In a further embodiment, the shrink compression joint is formed through the use of a magnetic pulse process in which the electrically conducting, ductile metallic material forms a gastight joint under compression stress with the cylindrical tube of dielectric material under the influence of pulses of a strong magnetic field.

Favorably, the bush of electrically conducting, ductile metallic material is provided with a tag situated outside the shrinkage area, to which tag an electrical conductor is connected for connecting a current source. Preferably, said tag and the bush form an integral whole, and the electrical conductor is preferably fastened to the tag by means of spot welding. This also contributes to a readily realizable mass manufacture.

The low-pressure gas discharge lamp according to the invention is highly suitable for being accommodated in a housing which forms a reflector. The lamp is then highly suitable for use as a background illumination for a liquid crystal display.

Favorably, the reflector may then be formed as an elongate channel of aluminum, the end portions of the lamp which form the coupling structures being encapsulated in a thermally conducting but electrically insulating synthetic resin inside the end portions of the reflector.

A particularly good heat removal is obtained with a synthetic resin consisting of polyurethane filled with 50% aluminum trihydrate.

Figure 2:
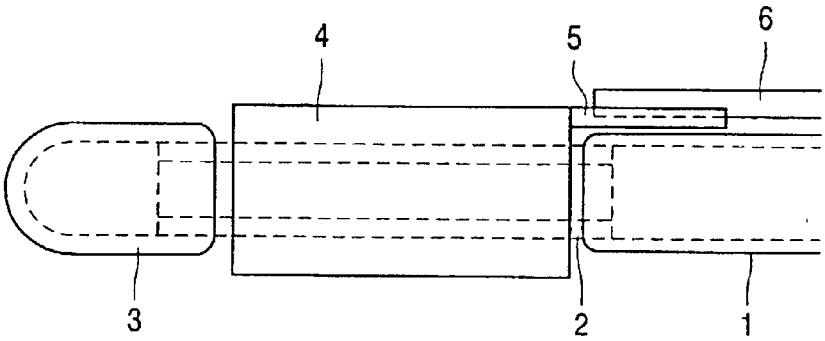

The invention will now be explained in more detail with reference to an embodiment shown by way of example in the drawing. In the drawing:

FIG. 1 shows a low-pressure gas discharge lamp with a capacitive coupling structure, and FIG. 2 shows an end portion of the lamp of FIG. 1 with an electrical connection according to the invention.

In FIG. 1, a capacitive gas discharge lamp is depicted (by way of example, to which the invention is not limited), which is yet to be provided with the measures according to the invention. A glass tube 1 serves as the discharge vessel and may be provided with a phosphor layer, such that the lamp can emit radiation in the UV range. The glass tube 1 has an internal diameter of 3 mm, an external diameter of 4 mm, a length of 40 mm, and may be filled with 50 mbar Ar and 5 mg Hg. A capacitive coupling structure is formed at either end by a cylindrical tube 2 of dielectric material (a ceramic oxide such as, for example, $BaTiO_3$, $SrTiO_3$, or $PbZrO_3$). The dielectric cylinder 2 has an external diameter of just below 3 mm, a wall thickness of 0.5 mm, and a length of 14 mm. The dielectric cylinder 2 is connected to the glass tube 1 at one side by means of a glass fusion process, and is closed in a vacuumtight manner at the other side with a glass seal 3.

The coupling structure comprising the dielectric cylinder can be connected to an external current supply by means of an electrical conductor (not shown). The external current supply in this embodiment may be formed by a lamp driver circuit which supplies a current of 30 mA at 40 kHz and average voltage of approximately 350 V. The lamp then generates a luminous flux of approximately 600 lumens during stationary operation. The driver unit further comprises an element for igniting the lamp. A stationary gas discharge is formed after the ignition.

A gas discharge lamp as shown in FIG. 1 is to be provided with electrical connection means. Preferably, attention should also be paid to the heat removal. The economic viability of the lamp requires that the electrical connection and the heat removal should be suitable for mass manufacture.

FIG. 2 shows an end portion of the gas discharge lamp provided with electrical connection means which are preferably used. The cylindrical tube 2 of dielectric material is not provided with an electrically conducting paste here, but instead a bush 4 is directly provided on the dielectric material of the cylindrical tube so as to form a gastight joint which is under compression stress.

This gastight joint under compression stress can be readily provided in mass manufacture. The bush 4 of electrically conducting, ductile metallic material is provided on the cylindrical tube 2 of dielectric material by means of a shrink compression joint. The material of the tube 4 is for this purpose ductile and is preferably formed by copper, brass, aluminum, or mild steel. The connection of the bush 4 to the tube 2 may be effected before the dielectric tube 2 is fused into the glass tube 1, after an end of the tube 2 has been fused into the glass tube 1, or after the discharge lamp has been manufactured as shown in FIG. 1. This choice will depend on the production sequence chosen in the mass manufacturing process.

The gastight bush 1 under compression stress forms an excellent electrical and mechanical connector. The shrink joint may be formed through the use of the difference in thermal expansion between the dielectric material of the cylindrical tube 2 and the metallic material of the electrically conducting bush 4. Alternatively, the shrink joint may be formed through the use of a magnetic pulse process (electromagnetic forming) which is known per se, but which has never been utilized for gas discharge lamps, wherein the electrically conducting, ductile metallic material is made to form a gastight joint under compression stress with the cylindrical tube of dielectric material under the influence of pulses of a strong magnetic field.

The bush 4 of electrically conducting, ductile metallic material is provided with a tag 5 which is situated outside the shrinkage area and to which an electrical conductor 6 is connected for connecting a current source. Preferably, the tag 5 is integral with the bush 4. The electrically conducting wire 5 is preferably connected to the tag by means of spot welding.

The gas discharge lamp may advantageously be accommodated in a reflector (not shown) which forms a housing. The reflector is preferably formed by an elongate aluminum channel. On the one hand, aluminum has a strong reflective power, while on the other hand it contributes considerably to the heat removal. To fix the lamp in the channel, the end portions of the lamp comprising the coupling structures are encapsulated in a thermally conducting but electrically insulating synthetic resin inside the end portions of the reflector. Thus the lamp is fastened in the reflector, while the synthetic resin also contributes to a further heat removal.

The synthetic resin is preferably formed by polyurethane. To increase the heat removal, the polyurethane may be filled with a thermally conducting, electrically insulating filler such as, for example, aluminum trihydrate.

A preferred embodiment of the invention was described above. It is obvious that modifications are possible within the scope of the appended claims.

What is claimed is:

1. A low-pressure gas discharge lamp comprising a discharge vessel and at least two capacitive coupling structures which are spatially separated from one another, said discharge vessel having a small diameter of preferably 5 mm or less, while each coupling structure is formed by at least a cylindrical tube of dielectric material, characterized in that an element acting as an external capacitor plate of the capacitive coupling structure is constructed as a bush of electrically conducting, ductile metallic material, which bush is provided directly on the dielectric material of the cylindrical tube so as to form a gastight connection which is under compression stress.

2. A low-pressure gas discharge lamp as claimed in claim 1, characterized in that the bush is formed from one or several of the materials copper, brass, aluminum, and mild steel.

3. A low-pressure gas discharge lamp as claimed in claim 2, characterized in that the bush made of an electrically conducting, ductile metallic material is provided on the cylindrical tube of dielectric material by means of a shrink compression joint.

4. A low-pressure gas discharge lamp as claimed in claim 3, characterized in that the shrink compression joint is obtained through the use of the difference in thermal expansion between the dielectric material of the cylindrical tube and the metallic material of the electrically conducting bush.

5. A low-pressure gas discharge lamp as claimed in claim 3, characterized in that the shrink compression joint is formed through the use of a magnetic pulse process in which the electrically conducting, ductile metallic material forms a gastight joint under compression stress with the cylindrical tube of dielectric material under the influence of pulses of a strong magnetic field.

6. A low-pressure gas discharge lamp as claimed in claim 1, characterized in that the bush of electrically conducting, ductile metallic material is provided with a tag situated outside the shrinkage area, to which tag an electrical conductor is connected for connecting a current source.

7. A low-pressure gas discharge lamp as claimed in claim 6, characterized in that the tag and the bush form an integral whole.

8. A low-pressure gas discharge lamp as claimed in claim 1, characterized in that the lamp is accommodated in a housing which forms a reflector.

9. A low-pressure gas discharge lamp as claimed in claim 8, characterized in that the reflector is formed as an elongate aluminum channel, the end portions of the lamp which comprise the coupling structures being encapsulated in a thermally conducting but electrically insulating synthetic resin inside the end portions of the reflector.

10. A low-pressure gas discharge lamp as claimed in claim 9, characterized in that the synthetic resin consists of polyurethane filled with 50% aluminum trihydrate.

* * * * *